US008767063B1

(12) United States Patent
Berger, III et al.

(10) Patent No.: US 8,767,063 B1
(45) **Date of Patent: *Jul. 1, 2014**

(54) SYSTEM FOR MONITORING A MARINE WELL FOR SHALLOW-WATER FLOW

(71) Applicant: Berger Geosciences, LLC, Houston, TX (US)

(72) Inventors: William J. Berger, III, Jersey Village, TX (US); James F. Keenan, Richmond, TX (US); William J. Berger, II, Stagecoach, TX (US)

(73) Assignee: Berger Geosciences, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,597

(22) Filed: Feb. 24, 2014

Related U.S. Application Data

(60) Provisional application No. 61/859,159, filed on Jul. 26, 2013.

(51) Int. Cl.
*H04N 9/47* (2006.01)
*E21B 7/12* (2006.01)
*E21B 47/10* (2012.01)

(52) U.S. Cl.
CPC ..... *E21B 47/10* (2013.01)
USPC ..... 348/85; 175/5

(58) Field of Classification Search
USPC ..... 348/85
See application file for complete search history.

(56) References Cited

U.S. PATENT DOCUMENTS

| | | | | |
|---|---|---|---|---|
| 4,520,665 | A * | 6/1985 | Cordier et al. | 73/152.19 |
| 4,759,636 | A * | 7/1988 | Ahern et al. | 367/21 |
| 4,948,258 | A * | 8/1990 | Caimi | 356/603 |
| 7,036,451 | B1 * | 5/2006 | Hutchinson | 114/364 |
| 2002/0063628 | A1 * | 5/2002 | Chuang | 340/612 |
| 2006/0186889 | A1 * | 8/2006 | Andreis | 324/345 |
| 2007/0021916 | A1 * | 1/2007 | MacGregor et al. | 702/13 |
| 2008/0008031 | A1 * | 1/2008 | Vigen et al. | 367/15 |
| 2010/0005857 | A1 * | 1/2010 | Zhang et al. | 73/29.02 |

* cited by examiner

*Primary Examiner* — Sath V Perungavoor
*Assistant Examiner* — Peter D Le
(74) *Attorney, Agent, or Firm* — Buskop Law Group, PC; Wendy Buskop

(57) ABSTRACT

A system for monitoring an open hole section of a marine well for shallow-water flow during marine drilling operations. The system for monitoring uses time periods and intervals while mud pumps are turned off. The system uses a video feed, and a processor with data storage containing a discharge category model. The data storage receives a drilling parameter data feed, a seismic profile data feed, a logging while drilling data feed, and a measurement while drilling data feed, which are used to verify a determined discharge category as a baseline discharge category. The system provides an alarm when a discharge emergency is ascertained due to a change in discharge category without an anticipated change, or changes outside acceptable limits.

11 Claims, 12 Drawing Sheets

316
320

ANALYSIS PROCESSOR
310
ANALYSIS DATA STORAGE
312
LOGGING WHILE DRILLING SERVER
332
LOGGING WHILE DRILLING DATA FEED
330
321
340
DRILLING SERVER
338
DRILLING PARAMETER DATA FEED
344
MEASUREMENT WHILE DRILLING SERVER
342
MEASUREMENT WHILE DRILLING DATA FEED
336
SEISMIC SERVER
334
SEISMIC PROFILE DATA FEED
MUD PUMPS
328
326
315
314
317
3
4
5
322

SYSTEM FOR MONITORING A MARINE WELL FOR SHALLOW-WATER FLOW

CROSS-REFERENCE TO RELATED APPLICATION

The current application claims priority to and the benefit of co-pending Provisional Patent Application Ser. No. 61/859,159 filed on Jul. 26, 2013, entitled "METHOD AND SYSTEM FOR MONITORING MARINE SHALLOW-WATER FLOW DURING MARINE DRILLING OPERATIONS." This reference is hereby incorporated in its entirety.

FIELD

The present embodiments generally relate to a system for monitoring a marine well for shallow-water flow during marine drilling operations.

BACKGROUND

A need exists for a system to monitor a marine well for shallow-water flow during marine drilling operations and to provide an early indication of subterranean formation problems by analyzing discharge volumes through open hole sections of marine wells.

A further need exists for a system to monitor a marine well for shallow-water flow during marine drilling operations utilizing a video feed and a discharge category model during actual drilling operations to create a discharge category for the marine well and then additionally to verify the discharge category model results using data feed in real time, 24 hours a day, 7 days a week, from a plurality of data feeds including but not limited to seismic profile data feeds, measurement while drilling data feeds, logging while drilling data feeds, and drilling parameter data feeds and further to monitor discharge and classify additional discharge over time to verify that the baseline category of discharge is valid or another category of discharge needs to become the new baseline discharge category.

A need exists for a system to monitor a marine well for shallow-water flow during marine drilling operations that provides the analysis while the mud pumps are turned off, such as when tubulars are connected to a drill string.

A need exists for a system to monitor a marine well for shallow-water flow during marine drilling operations that can create immediate alarms regarding potentially dangerous situations and transmit those remote alarms to client devices connected to the marine well, such as through a network.

The present embodiments meet these needs.

BRIEF DESCRIPTION OF THE DRAWINGS

The detailed description will be better understood in conjunction with the accompanying drawings as follows.

Figure 1:
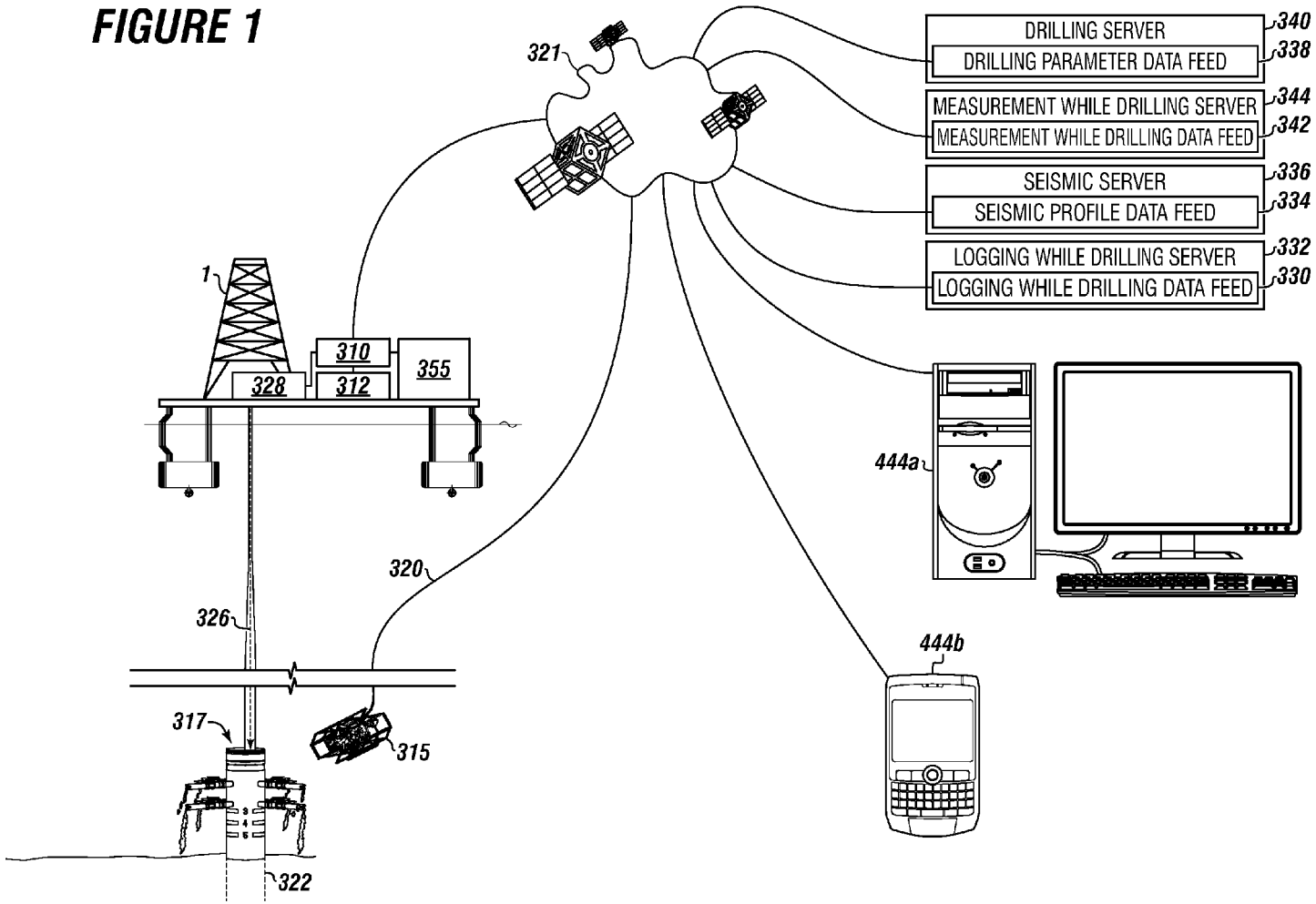
FIG. 1 depicts a diagram of a system for monitoring a marine well for shallow-water flow during marine drilling operations depicting an open hole section of the marine well.

The present embodiments are detailed below with reference to the listed Figures.

DETAILED DESCRIPTION OF THE EMBODIMENTS

Before explaining the system in detail, it is to be understood that the system is not limited to the particular embodiments and that it can be practiced or carried out in various ways.

The present embodiments generally relate to a system for monitoring a marine well for shallow-water flow during marine drilling operations.

The present embodiments use a discharge category model with a video feed at a first time period to determine a baseline discharge category from the marine well.

The embodiments use a video feed at a subsequent time period to classify a discharge category from the marine well.

Computer instructions in a data storage connected to a processor are used to compare the discharge categories and to provide a recommendation to change the baseline discharge category to a subsequent discharge category if warranted.

Computer instructions in the data storage are used to connect to various data feeds concerning the marine well and compare the marine well information from those data feeds to verify if the subsequent discharge category should be used as the new baseline discharge category.

The various data feeds include logging while drilling data feeds, seismic profile data feeds, drilling parameter data feeds, and measurement while drilling data feeds.

The data feeds can be provided from separate servers collecting marine well information on the particular well during drilling operations and prior to drilling operations. The servers are connected to a network which communicates with an analysis processor which can be on a drilling rig, or located remotely, during drilling of the marine well for the purpose of monitoring for shallow-water flow.

The analysis processor communicates the data feeds to the data storage associated with the analysis processor and uses computer instructions to perform comparisons of the data feeds to the subsequent discharge category assigned to the marine well at the subsequent time period.

Computer instructions in the analysis data storage are used to create an alert transmitted by the analysis processor via the network if the computer instructions determine that a change in discharge exceeds a baseline discharge category.

In embodiments, an alarm can be an audible alarm, an email or a visual graphic displayed on a display of a client device connected to the network.

In embodiments, an alert can be an audible alarm, an email or a visual graphic displayed on a display of a client device connected to the network.

In embodiments, the discharge category model and computer instructions can be used to display a spreadsheet like report, wherein the report can provide mathematical calculations, such as an EXCEL™ spreadsheet or the like, on the display of the client device.

The system helps reduce toxic spills in the marine environment by early detection of hydrocarbon flows. The system for monitoring the marine well for shallow-water flow during marine drilling operations can transmit an alarm if the discharge category model detected matches a dangerous discharge category that requires investigation.

The alarm can be transmitted to a plurality of users simultaneously. Early detection of hydrocarbons can be communicated for rapid response to minimize the environmental impact of the effect of hydrocarbon flows into the marine environment.

The system saves lives by eliminating the need for divers to personally go and inspect an open hole section of the marine well to verify the discharge category of the open hole section.

The system can be used for monitoring a marine well for shallow-water flow during marine drilling operations and for detecting shallow-water flow which can prevent the costly loss of the well, and prevent a need for additional crews to spud a new well, or respud an old well.

The system for monitoring a marine well for shallow-water flow during marine drilling operations prevents the need for additional heavy equipment which can fall on the crews and cause injury.

This system helps keep drilling rig personnel safe.

The system avoids the need to use additional high pressure nitrogen on the drilling rig. The system prevents explosions on a rig floor during cementing operations by avoiding the need for additional use of nitrogen under pressure.

The system reduces the need for additional cementing operations which require high pressure nitrogen.

The system helps reduce fossil fuel costs by saving rig time by drilling safe wells, reducing rig time, and reducing emissions and fuel consumption. There is also a concurrent reduction in man hour exposure to potential harmful activities on the rig.

To understand this invention further, various terms are used herein to describe the system for monitoring a marine well for shallow-water flow during marine drilling operations.

The term "drilling rig" as used herein can refer to a drilling rig, a drill ship, a platform, a semi-submersible, or a similar rig that is commonly known in the industry.

The term "drilling fluid" as used herein can refer to muds, sea water, drill cuttings and combinations thereof, used in drilling a well. Some gas bubbles can also be entrained in the drilling fluid.

The term "real time" as used herein can refer to a live video capture with optional live data capture that can occur using sensors at a moment in time that is the same moment in time that the data is captured.

The term "subsequent" as used herein can refer to a second, third, fourth, or any further term after the first.

The term "time period" as used herein can refer to the time from when the mud pumps are turned off until the mud pumps are turned on.

The term "time interval" as used herein can refer to the time from when the mud pumps are turned off to the time when a first pattern of discharge of muds and cuttings from the marine well is observed.

The embodiments relate to a system for monitoring of an open hole section of a marine well for shallow-water flow during marine drilling operations while mud pumps are turned off.

The system for monitoring a marine well for shallow-water flow during marine drilling operations can use a video feed to display the underwater open hole section of the marine well.

The video feed can be transmitted to an analysis processor that additionally and simultaneously receives drilling parameter data feed, seismic profile data feed, logging while drilling data feed, and measurement while drilling data feed.

The video feed can be provided to the analysis processor from a video capturing device, such as an underwater camera on a remotely operated vehicle (ROV), or a camera connected to a pole or fixed structure pointed at the open hole section of the marine well and placed underwater.

The video capture device can be operatively positioned by attaching the video capture device to a portion of the marine well, to equipment adjacent to the marine well, or on a remotely operated vehicle (ROV) which can be tethered or tether-less, as long as the video capture device can communicate the video feed electronically to the processor, and in embodiments, to a network.

The analysis processor can be a computer, a lap top, a tablet, a portable digital device, or other computing device configured to receive, store and display video information from the ROV.

The video feed can be transferred to the analysis processor using known telemetry, such as fiber optics, wireless transmission, or direct connection through a network.

If not already activated the video feed to the analysis processor is initiated when mud pumps that circulate drilling fluid into the well are turned off.

The analysis processor registers the moment in time when the mud pumps are turned off and measures a first time period from the moment the drilling fluid is stopped, and then a first analysis is performed to determine a baseline discharge category with the first time interval and a discharge category which can be any of the categories of the discharge category model as seen in FIGS. 4A-4F in the analysis data storage.

The analysis processor repeats the analysis for a subsequent time period, forming a subsequent discharge category. The subsequent discharge category can be any of the categories of the discharge category model as seen in FIGS. 4A-4F.

If the subsequent discharge category from the subsequent time period is different from the baseline discharge category or if the subsequent time period of the subsequent discharge category changes from the first time period, such as by 10 percent, then the analysis processor verifies if the subsequent discharge category has a problem by checking the various data feeds, for change. If an anticipated change or change outside of acceptable limits in the data feeds can be associated with drilling operations and not related to shallow-water flow, the subsequent discharge category becomes the baseline. If a change in the data feeds occurs that is determined to be related to shallow-water flow, an alarm is transmitted to the users of client devices connected to the network to investigate a potentially dangerous situation.

Turning to the Figures, FIG. 1 depicts a diagram of the system for monitoring a marine well for shallow-water flow during marine drilling operations having the marine well 322 with shallow-water flow monitoring with a drilling rig 1 with an open hole section 317.

Mud pumps 328, at the drilling rig 1, pump drilling fluid 326 into the marine well 322 during drilling.

An analysis processor 310 on the drilling rig 1 connects to a power supply 355 on the drilling rig and receives a video feed 320 of the open hole section 317 of the marine well 322 in real time, shown as a video feed 320 from a video capture device. The video capture device is shown on a remotely operated vehicle 315 (ROV).

The video feed 320 can be provided by a direct connection to the analysis processor 310 or by using a network 321 connected to the analysis processor 310. The video feed can be a live video feed.

The video feed 320 and well information data feeds from other servers concerning the marine well 322 are received by the analysis processor 310 and stored in the analysis data storage 312 connected to the analysis processor.

If not already engaged, the video feed 320 is initiated when mud pumps 328 supplying drilling fluid 326 to the marine well 322 are turned off.

When the mud pumps 328 are turned off, a mud pump time off marker is transmitted to the analysis processor 310 starting the analysis processor 310 computing a first time period.

In addition to the video feed 320, the analysis processor 310 can receive logging while drilling data feed 330 about the marine well 322 provided in real time using the network 321 during drilling operations by the drilling rig 1 from a logging while drilling server 332.

The analysis processor 310 can receive seismic profile data feed 334 about the marine well 322 provided in real time using the network 321 during drilling operations by the drilling rig 1 from a seismic server 336.

The analysis processor 310 can receive drilling parameter data feed 338 about the marine well 322 provided in real time using the network 321 during drilling operations by the drilling rig 1 from a drilling server 340.

The analysis processor 310 can receive measurement while drilling data feed 342 the marine well 322 provided in real time during drilling operations by the drilling rig 1 from a measurement while drilling server 344.

In embodiments, a single server can perform the duties of these four servers 340, 344, 336 and 332.

The network 321 can also be in communication with a plurality of client devices 444*a* and 444*b* that receive the alerts and the information on the baseline discharge category, the second, the third, the fourth, or the fifth discharge category with accompanying time periods from a mud pumps off event, and view the video feed 320 from the analysis processor 310 through the network.

The client devices can be cellular phones, desktop computers, personal digital assistant devices, laptops, tablets, similar devices, or combinations thereof.

Figure 2:
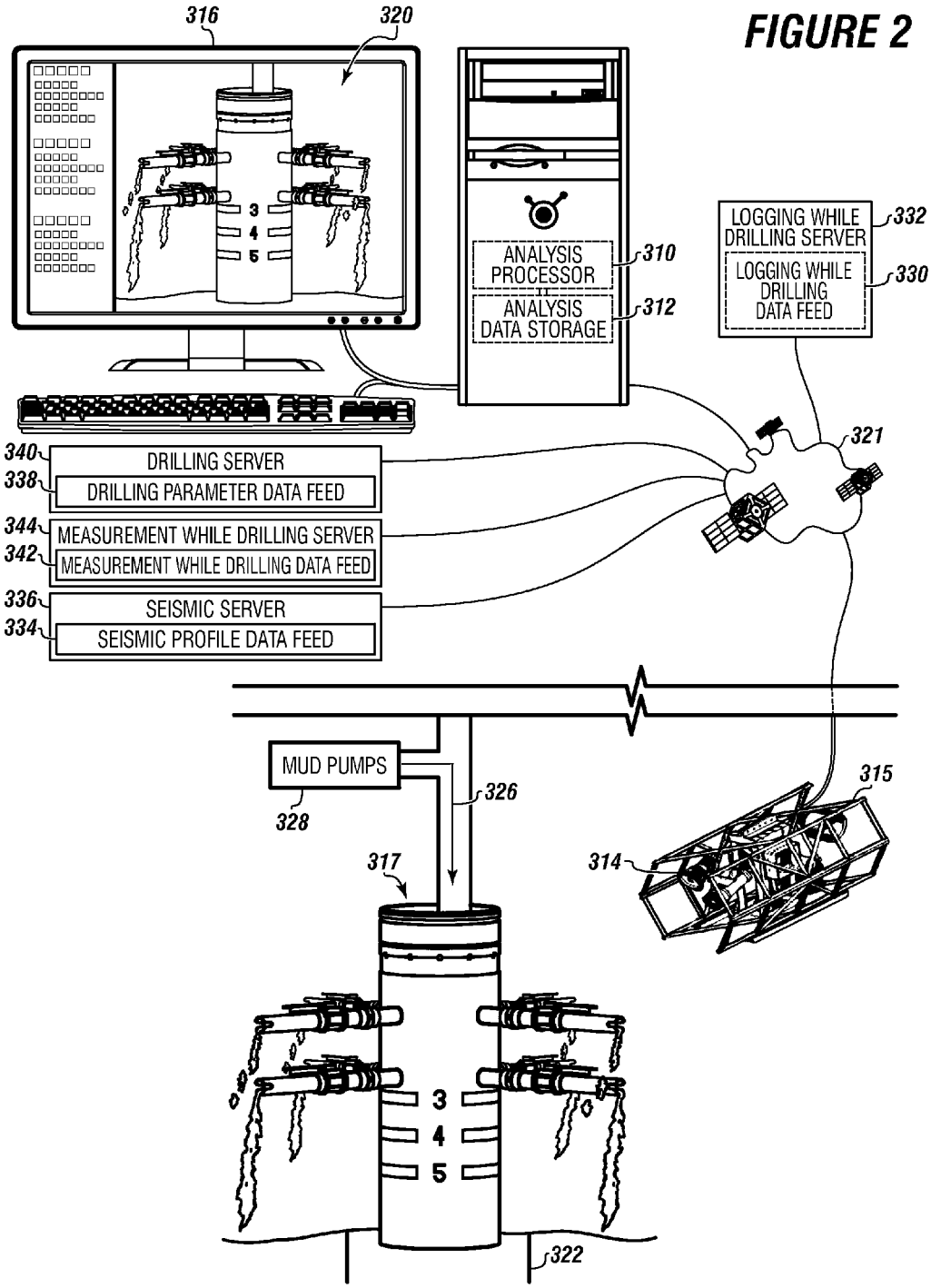
FIG. 2 depicts a detail of the system for monitoring a marine well for shallow-water flow during marine drilling operations.

FIG. 2 depicts a detail of the system for monitoring a marine well 322 for shallow-water flow during marine drilling operations showing the video feed 320 on a display device 316.

The analysis processor 310 is shown in communication with the analysis data storage 312.

The analysis processor 310 connects to the display device 316, which can display the determined baseline discharge category using the video feed 320 from a video capture device 314, mounted on a remotely operated vehicle 315 (ROV) and the discharge category model in the analysis data storage.

In this embodiment, the video capture device is shown as an underwater camera 314.

The analysis processor 310 can be any processor known in the art, a laptop, a desktop computer, a cell phone, a tablet, or a similar device.

The display device 316 can be a monitor, a TV screen, a display on a hand held device, or the like.

The network 321 can be the Internet, another global communication network, a local area network, a wide area network, a satellite network, or combinations thereof.

The display device 316 can be in communication with the video capture device 314 using any form of telemetry.

The video capture device can be a video feed recorder on a tethered remotely operated vehicle (ROV), or a video feed recorder mounted to subsea equipment adjacent to the well for viewing the open hole section 317 of the marine well 322.

The analysis data storage 312 can be a hard drive, a flash drive, or the like.

All servers of this invention can be computers, which are in communication with the network 321 to provide additional information to the analysis processor 310 with the discharge category model contained in the analysis data storage.

A seismic server 336 can be a computer with processor and data storage containing seismic profile data feed 334, which can provide the seismic profile data to the analysis processor 310 using the network.

A measurement while drilling server 344 can be a computer with processor and data storage containing measurement while drilling data feed 342, which can provide the measurement while drilling data to the analysis processor 310 using the network 321.

A drilling server 340 can be a computer with processor and data storage containing drilling parameter data feed 338, which can provide the drilling parameter data to the analysis processor 310 using the network.

A logging while drilling server 332 can be a computer, with processor and data storage containing logging while drilling data feed 330, which can provide the logging while drilling data to the analysis processor 310 using the network.

The mud pumps 328 shown on the drilling rig can circulate drilling fluid 326 to the open hole section 317 of the marine well 322 for analysis of the drilling operation.

Figure 3A:
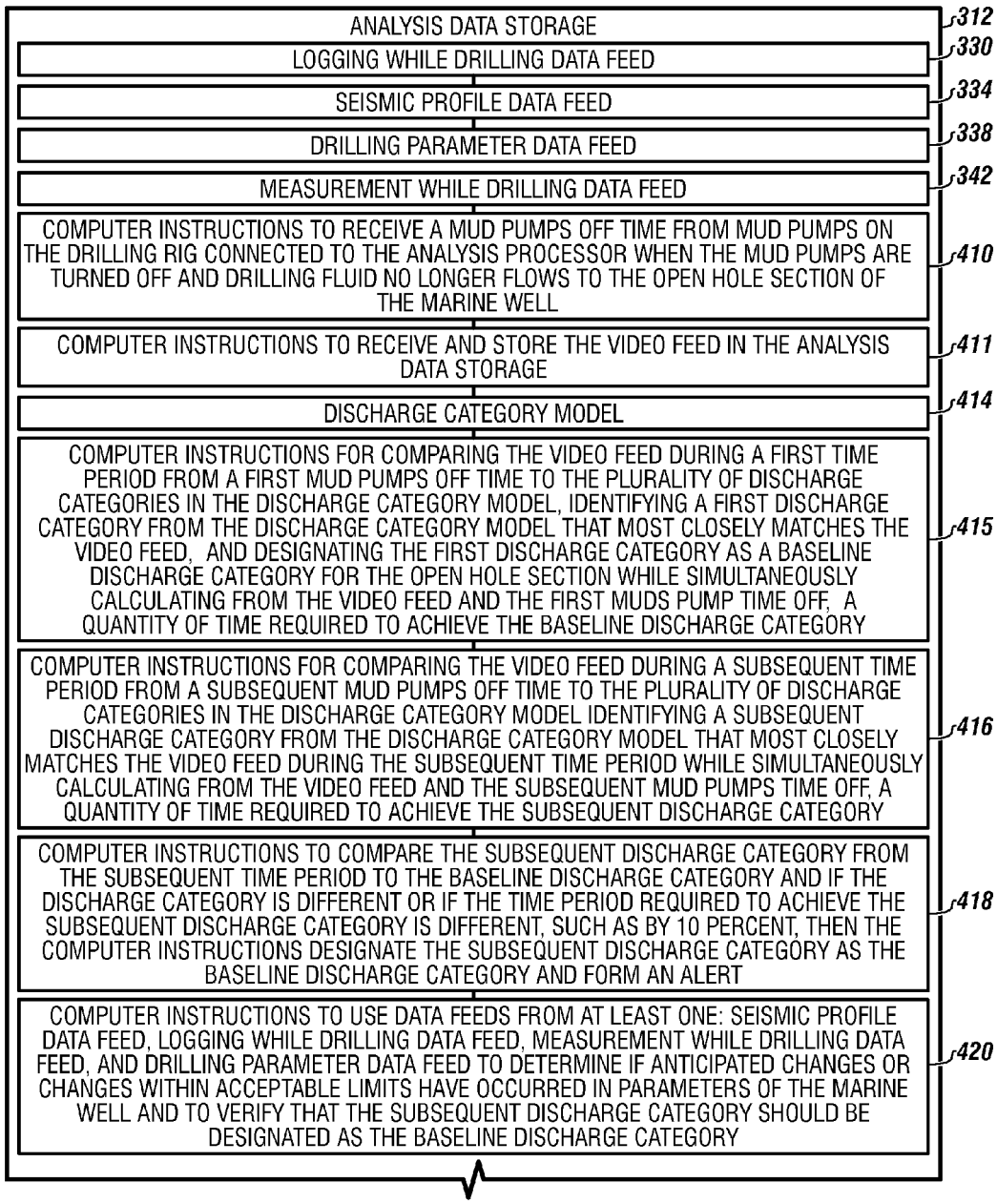
FIGS. 3A-3B depict a diagram of the computer instructions in analysis data storage which is part of the system for monitoring a marine well for shallow-water flow during marine drilling operations.
Figure 3B:
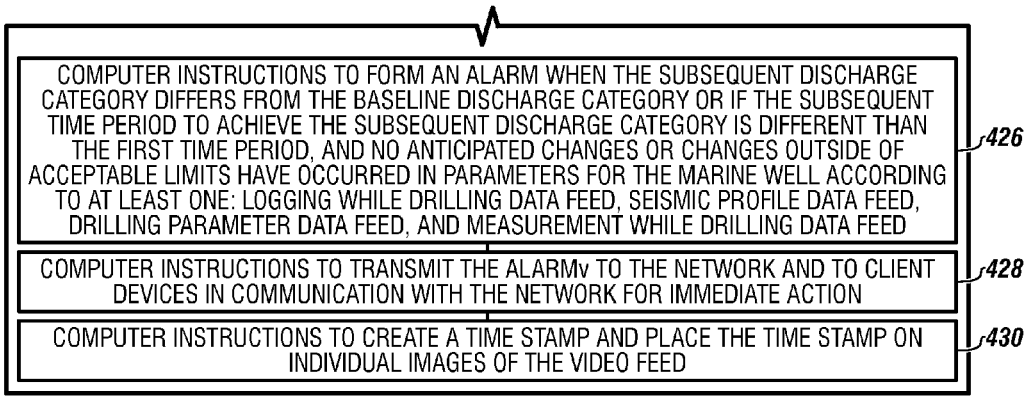

FIGS. 3A-3B depict a diagram of the computer instructions in the analysis data storage according to the marine well having a shallow-water flow monitoring system.

To clarify how the hardware and computer instructions operate the following exemplary scenario is provided.

As an example, during the first time period, from when the mud pumps pumping drilling fluids to the open hole section of a marine well are turned off until they are turned back on, the video feed from the video capture device is started and a time stamp of the date and time the mud pumps are turned off is created and stored in the analysis data storage.

The video feed is monitored for patterns of discharge of muds and cuttings from the marine well and classified into a category using the discharge category model.

The monitored patterns are analyzed for velocity of fluid flowing from valve and hole locations in the open hole section of the marine well and an initial baseline discharge category is assigned.

For example, the first time interval can be the difference in time from when the mud pumps are turned off to the time when a first pattern of discharge of muds and cuttings from the marine well is observed. The first time interval can be a 2 minute time interval from when the mud pumps are turned off. The discharge category model is used with information from the plurality of servers on the network to assign a baseline discharge category to the open hole section of the marine well.

The open hole section of the marine well is then observed for a subsequent time period to establish if a subsequent pattern of discharge of muds and cuttings from the marine well changes and the subsequent discharge category is different from the baseline.

The subsequent time interval can be 4 minutes.

The recorded observed patterns of discharge of muds and cuttings for observed time intervals are analyzed using the six categories of the discharge category model with each category in the model having a unique velocity and locations of discharge.

If the patterns of discharge of muds and cuttings and observed time intervals for subsequent connections match the baseline, then no additional analysis is needed other than continued monitoring for changes in the baseline discharge category.

If the patterns of discharge of muds and cuttings for the subsequent observed time period does not match the baseline, further analysis is performed. For example, the baseline can be for a first time interval of 10 seconds a baseline discharge category 2, and for a subsequent time interval of 20 minutes a discharge of category 4. Since the baseline does not match the subsequent interval pattern an analysis is performed using the seismic profile data feed, the measurement while drilling data feed, the logging while drilling data feed and the drilling parameters data feed to determine if an alert is to be generated or if a new baseline is to be established equivalent to the subsequent discharge category.

However, if an alert is generated, then additional analysis can be performed, including subsequent observations of the patterns of discharge of muds and cuttings and further analysis of the drilling parameter data feed, seismic profile data feed, the measurement while drilling feed, and the logging while drilling data feed.

If the additional analysis concludes that the deviation from the baseline is due to an anticipated change or change within acceptable limits in the seismic profile data feed, the measurement while drilling data feed, the logging while drilling data feed and the drilling parameters data feed, then a new baseline can be established.

If the additional analysis concludes that the deviation from the baseline is not due to an anticipated change or change within acceptable limits in the seismic profile data feed, the measurement while drilling data feed, the logging while drilling data feed and the drilling parameters data feed, further shallow-water flow analysis can be initiated and alarms can be transmitted.

The analysis data storage 312 can be connected to the logging while drilling data feed 330, the seismic profile data feed 334, the drilling parameter data feed 338, and the measurement while drilling data feed 342.

The analysis data storage 312 can have computer instructions 410 to receive a mud pumps off time from mud pumps on the drilling rig connected to the analysis processor when the mud pumps are turned off and drilling fluid no longer flows to the open hole section of the marine well.

The analysis data storage 312 can have computer instructions 411 to receive and store the video feed in the analysis data storage.

The analysis data storage 312 can contain a discharge category model 414, which can provide a plurality of discharge categories of shallow-water flow for open hole sections of marine wells.

The analysis data storage 312 can have computer instructions 415 for comparing the video feed during a first time period from a first mud pumps off time to the plurality of discharge categories in the discharge category model, identifying a baseline discharge category from the discharge category model that most closely matches the video feed, and designating the baseline discharge category as a baseline for the open hole section while simultaneously calculating from the video feed and the first mud pumps time off, a quantity of time required to achieve the baseline discharge category.

The analysis data storage 312 can have computer instructions 416 for comparing the video feed during a subsequent time period from a subsequent mud pumps off time to the plurality of discharge categories in the discharge category model, identifying a subsequent discharge category from the discharge category model that most closely matches the video feed during the subsequent time period while simultaneously calculating from the video feed and the subsequent mud pumps time off and a quantity of time required to achieve the subsequent discharge category.

The analysis data storage 312 can have computer instructions 418 to compare the subsequent discharge category from the subsequent time period to the baseline discharge category and if the discharge category is different or if the time period required to achieve the subsequent discharge category is different, such as by 10 percent, then the computer instructions designate the subsequent discharge category as the baseline discharge category and form an alert.

The analysis data storage 312 can have computer instructions 420 to use data feeds from at least one: seismic profile data feed, logging while drilling data feed, measurement while drilling data feed, and drilling parameter data feed to determine if anticipated changes or changes within acceptable limits have occurred in parameters of the marine well and to verify that the subsequent discharge category should be designated as the baseline discharge category.

The analysis data storage 312 can have computer instructions 426 to form an alarm when the subsequent discharge category differs from the baseline discharge category or if the subsequent time period to achieve the subsequent discharge category is different than the first time period, and no anticipated changes or changes outside of acceptable limits have occurred in parameters for the marine well according to at least one: logging while drilling data feed, seismic profile data feed, drilling parameter data feed, and measurement while drilling data feed.

The analysis data storage 312 can have computer instructions 428 to transmit the alarm to the network and to client devices in communication with the network for immediate action.

The analysis data storage 312 can have computer instructions 430 to create a time stamp and place the time stamp on individual images of the video feed.

FIGS. 4A-4F depict the categories of the discharge category model usable with the system for monitoring a marine well for shallow-water flow during marine drilling operations.

The discharge category model includes at least six discharge categories.

Figure 4A:
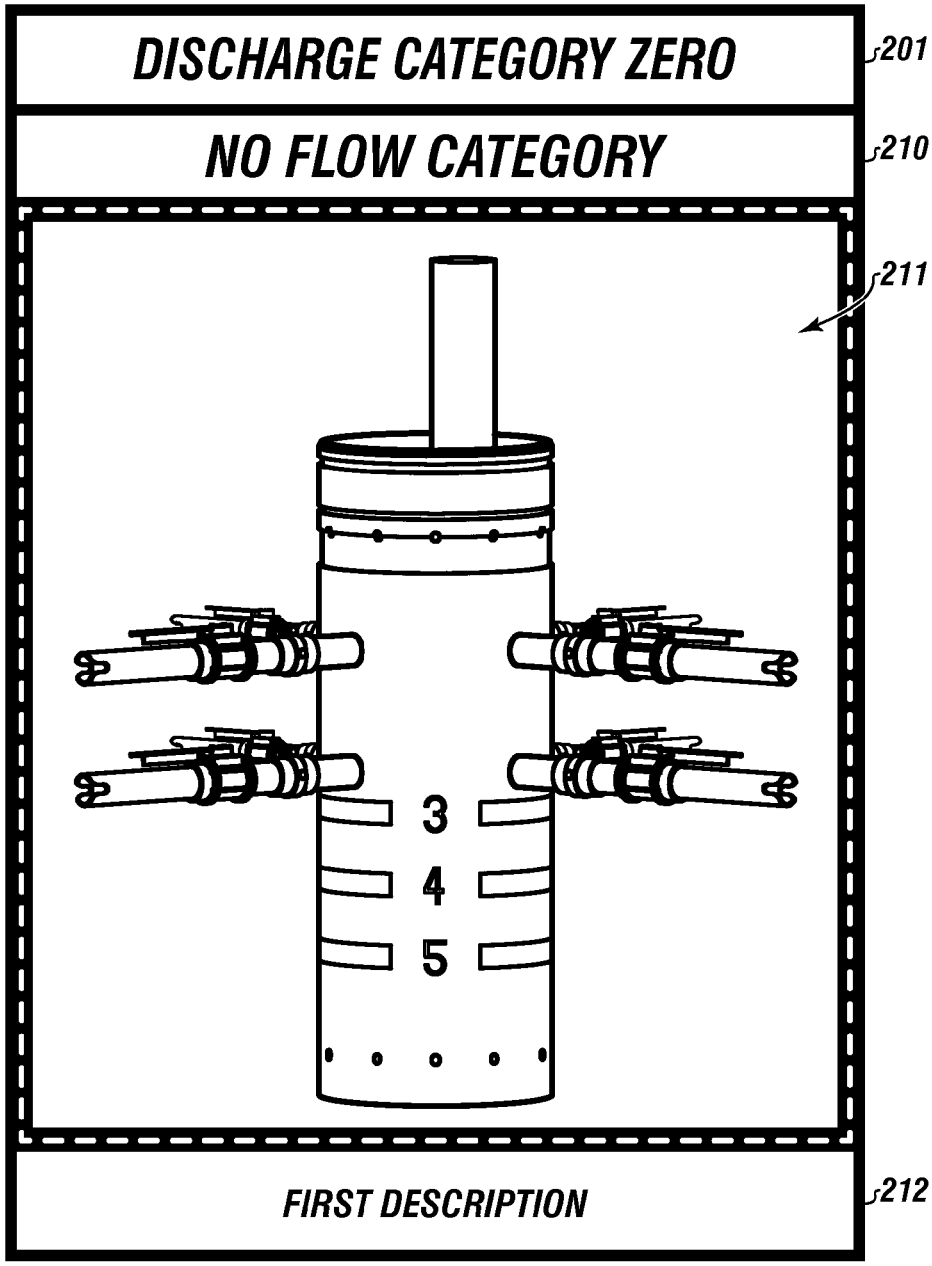
FIGS. 4A-4F depict categories of a discharge category model resident in the analysis data storage used in the system for monitoring a marine well for shallow-water flow during marine drilling operations.

FIG. 4A depicts discharge category zero 201 and the no flow category 210 can be associated with a first graphical depiction 211 and a first description 212. An example of a first description can be "no discharge of drilling fluids and cuttings is observed out of the wellhead or any port hole or port valve in the open hole section of the marine well while the mud pumps are off."

Figure 4B:
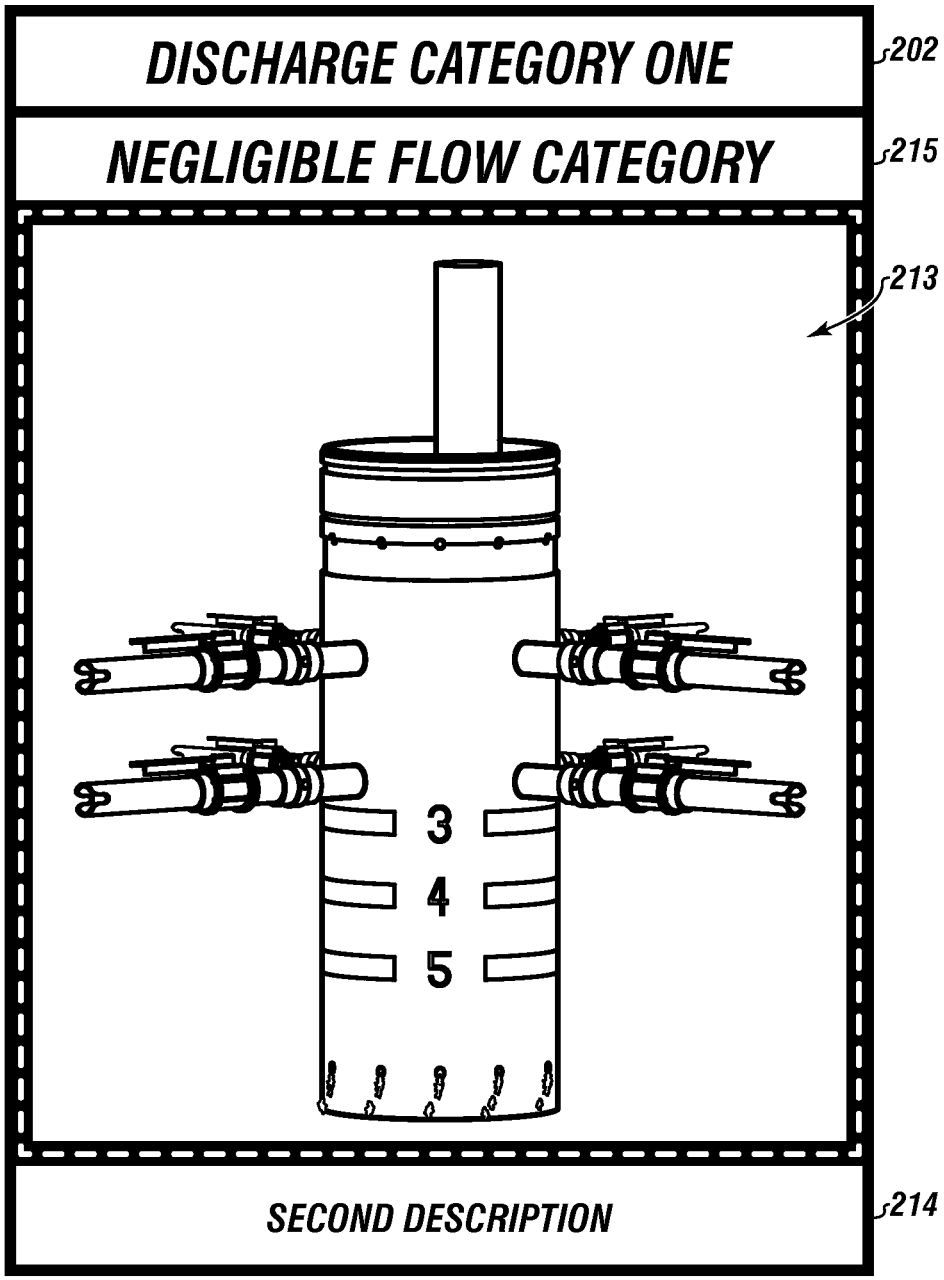

FIG. 4B depicts discharge category one 202 with the negligible flow category 215, a second graphical depiction 213 and a second description 214. An example of a second description can be "a negligible discharge at a first velocity of drilling fluids and cuttings is observed out of either a group of lowest port holes or a group of lowest port valves if no port holes are lowest, in the open hole section of the marine well."

Figure 4C:
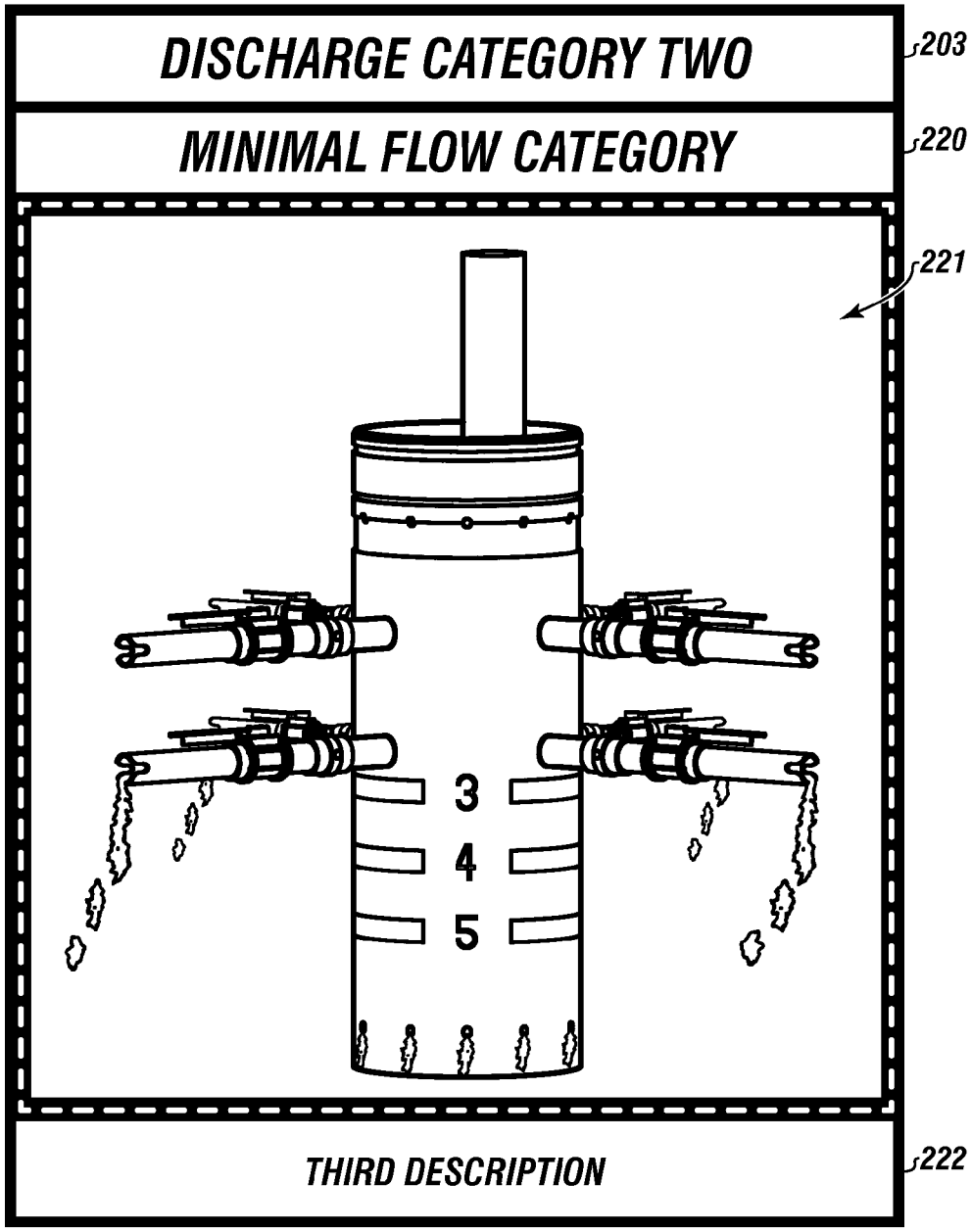

FIG. 4C depicts the discharge category two 203 with the minimal flow category 220, a third graphical depiction 221 and a third description 222. An example of a third description can be "a minimal flow discharge pattern at a first velocity of drilling fluids and cuttings observed out of a group of lowest port holes and a group of lowest port valves of the open hole section of the marine well."

Figure 4D:
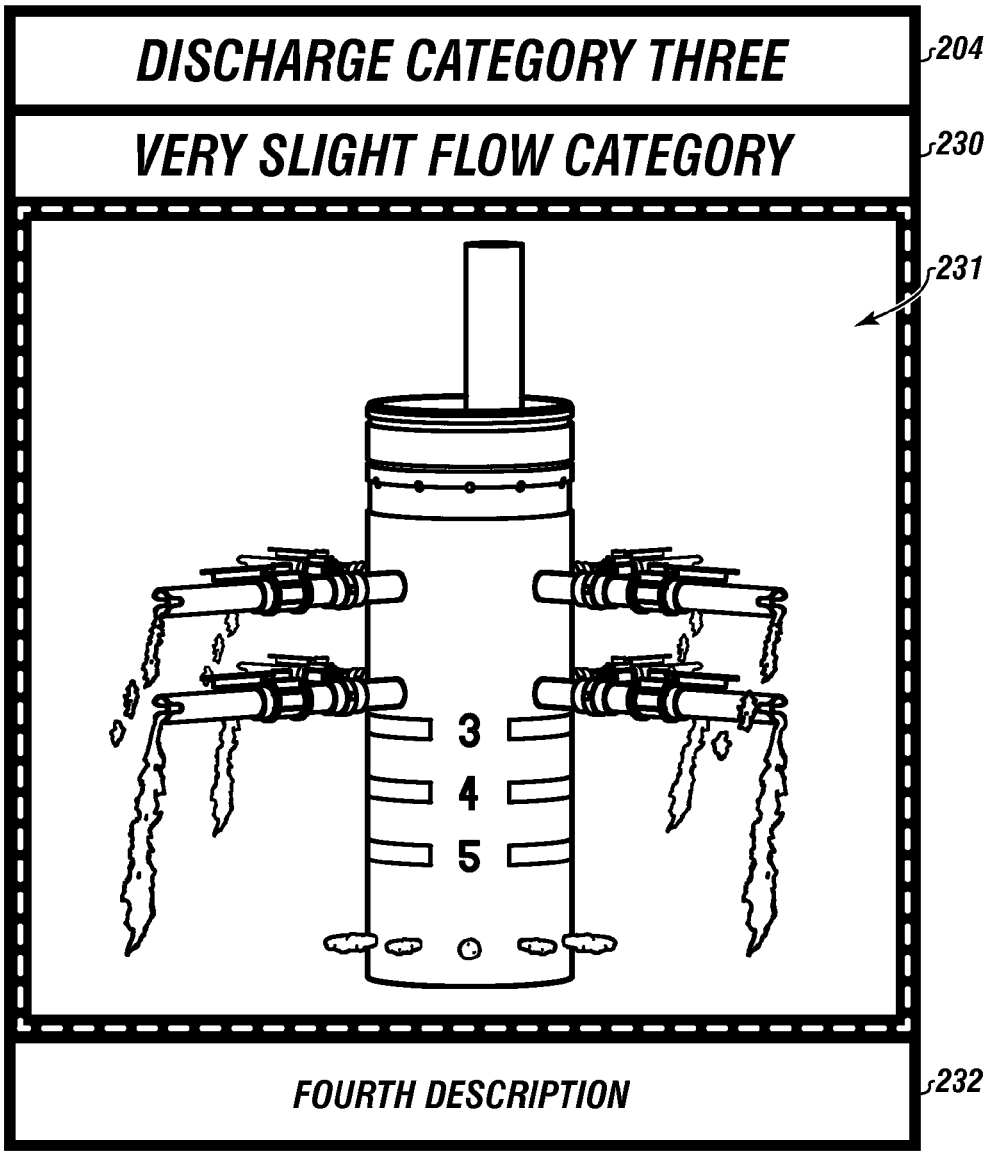

FIG. 4D depicts the discharge category three 204 and the very slight flow category 230 using a fourth graphical depiction 231 and a fourth description 232. An example of a fourth description can be "a very slight flow discharge pattern observed of drilling fluid and cuttings at a second velocity out of the open hole section of the marine well from a member of the group: the lowest port holes, lowest port valves, or combinations thereof; and a first velocity from a member of the group comprising: upper port valves, upper port holes, or combinations thereof."

Figure 4E:
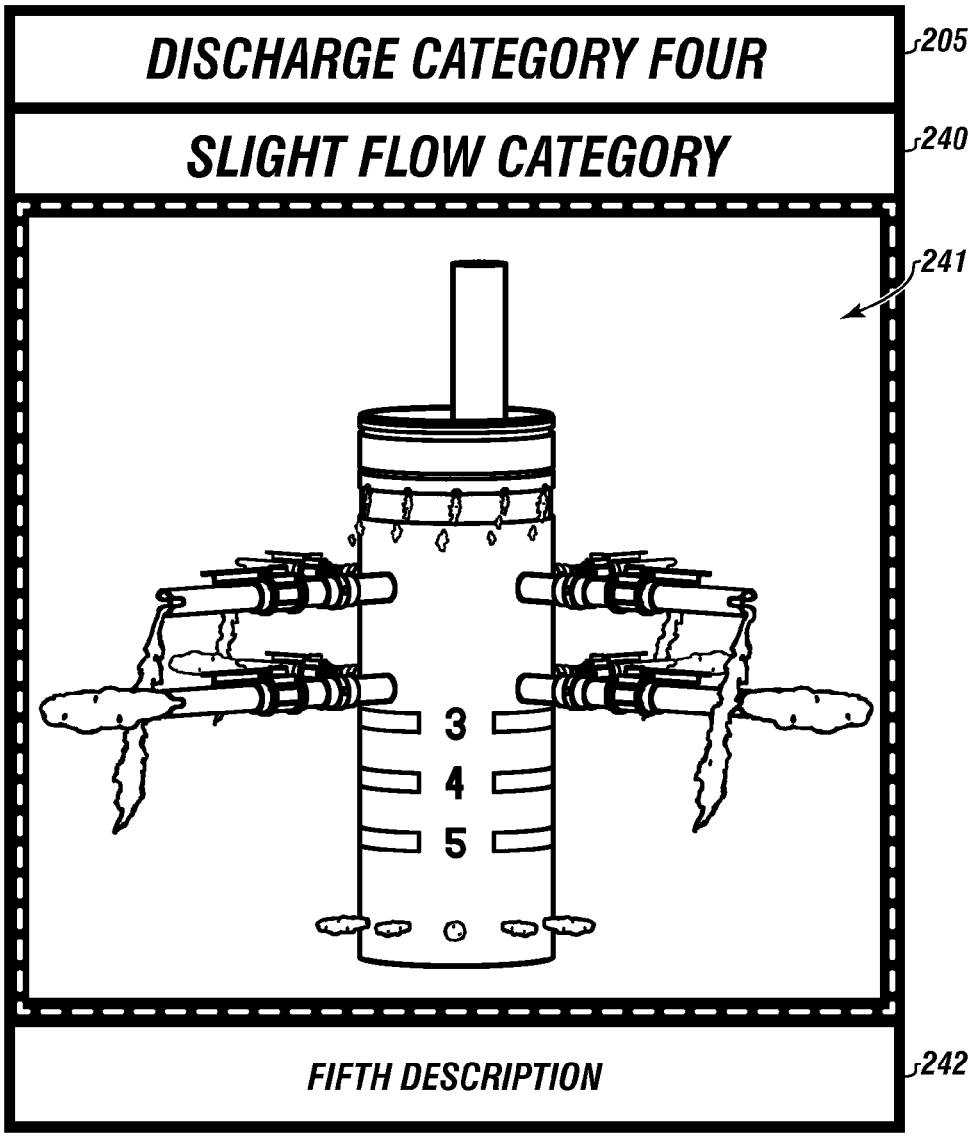

FIG. 4E shows the discharge category four 205 and the slight flow category 240 with a fifth graphical depiction 241 and a fifth description 242. An example of the fifth description can be "a slight flow discharge pattern observed of drilling fluid and cuttings observed out of the open hole section of the marine well with a third velocity from a member of the group: the lowest port holes, lowest port valves or combinations thereof; and either (i) a second velocity from the upper port holes, or (ii) a second velocity from upper port valves and a first velocity from the upper port holes, or combinations thereof."

Figure 4F:
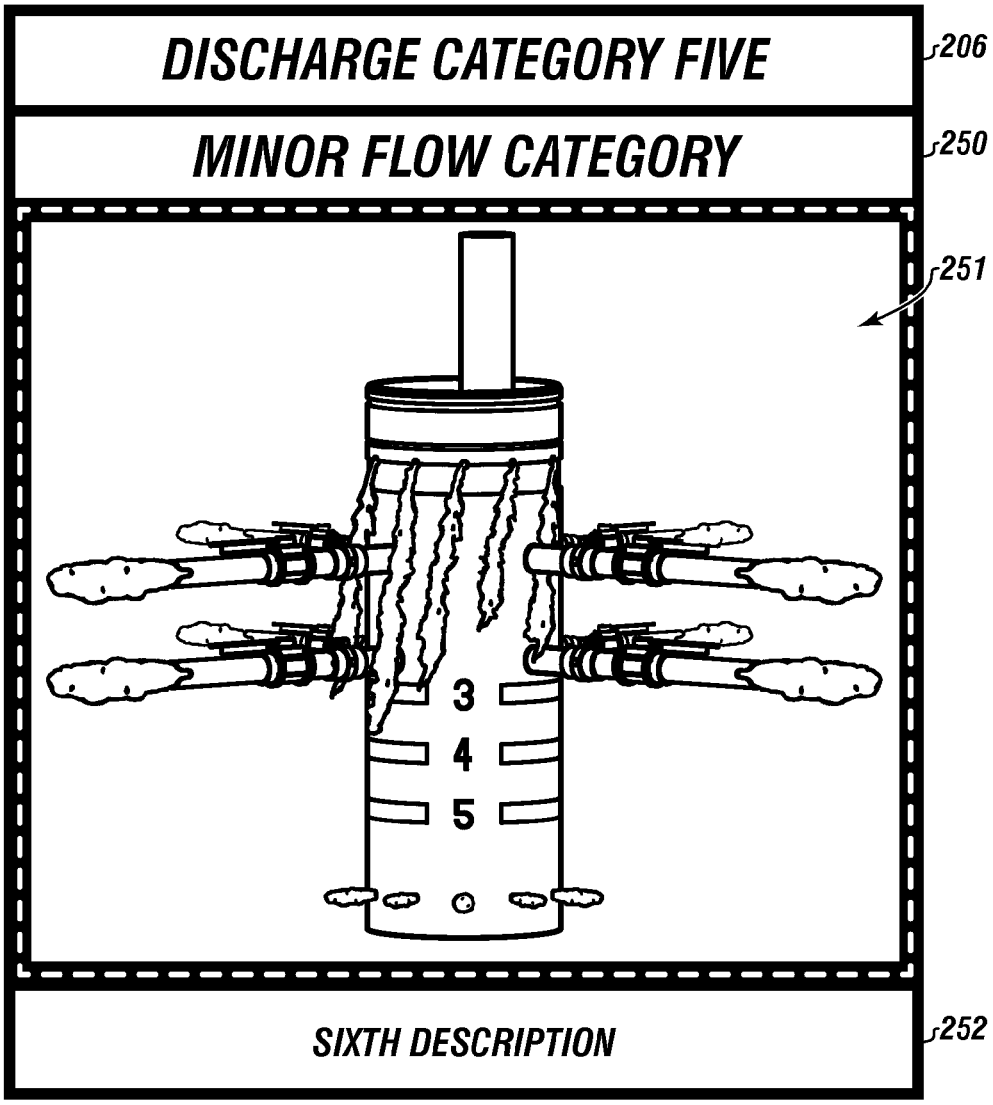

FIG. 4F shows the discharge category five 206 and the minor flow category 250 with a sixth graphical depiction 251 and a sixth description 252. An example of the sixth description can be "a minor discharge pattern observed of drilling fluid and cuttings out of the open hole section of the marine well with a third velocity from a member of the group: the lowest port holes, lowest port valves or combinations thereof; and a third velocity from upper port valves, and a second velocity from upper port holes, or combinations thereof."

The analysis data storage contains computer instructions that use the video feed and compares the video feed to images of each discharge category in the model.

In an embodiment, the computer instructions can be used to form a baseline discharge category and to identify trends of changes in discharge patterns of muds and cuttings out of the marine well using the observed time intervals and discharge patterns.

For example, if a discharge pattern is identified during a first time period of 2 minutes as discharge category 4 and assigned discharge category 4 as the baseline discharge category, and during a subsequent time period of 2 minutes a discharge category 5 is identified, then the baseline discharge category can be changed by the model to the higher category 5 as "a new baseline discharge category" if data feeds from the seismic server, drilling parameter drilling server, logging while drilling server and measurement while drilling server indicate a change should have occurred to the well because of a change in rock, a change in the profile of the formation or some other drilling parameter or seismic change.

Figure 5:
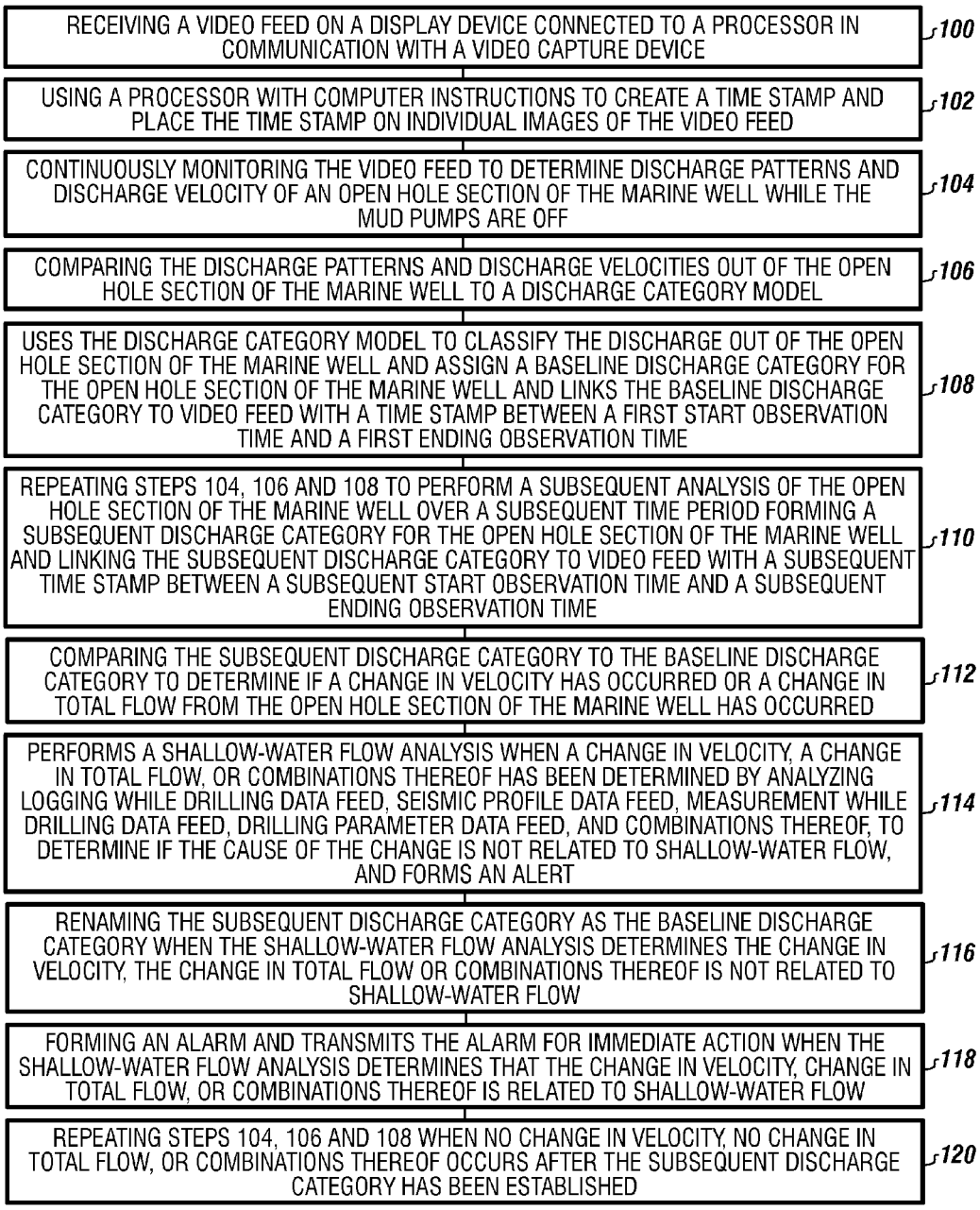
FIG. 5 is an embodiment of a series of steps performed by the system for monitoring a marine well for shallow-water flow during marine drilling operations.

FIG. 5 describes an embodiment of a series of steps used by a system for monitoring a marine well for shallow-water flow during marine drilling operations according to one or more embodiments.

The video feed can be continuously monitored by the analysis processor using the discharge category model to determine discharge patterns and discharge rates including discharge velocities of the open hole section from the marine well while the mud pumps are off.

The system for monitoring the marine well for shallow-water flow during marine drilling operations receives a video feed on a display device connected to a processor in communication with a video capture device, shown as step 100.

The video feed can include images of the subsea open hole section of the marine well before the mud pumps are turned off until after the mud pumps are turned on, such as when a connection is made.

The system for monitoring a marine well for shallow-water flow during marine drilling operations uses a processor with computer instructions to create a time stamp and place the time stamp on individual images of the video feed, shown as step 102.

The system for monitoring a marine well for shallow-water flow during marine drilling operations continuously monitors the video feed to determine discharge patterns and discharge velocity of an open hole section of the marine well while the mud pumps are off, shown as step 104.

The system for monitoring a marine well for shallow-water flow during marine drilling operations compares the discharge patterns and discharge velocities out of the open hole section of the marine well to a discharge category model, shown as step 106.

The system for monitoring a marine well for shallow-water flow during marine drilling operations uses the discharge category model to classify the discharge out of the open hole section of the marine well and forms a baseline discharge category for the open hole section of the marine well and links the baseline discharge category to the video feed with a time stamp between a first start observation time and a first ending observation time, shown as step 108.

The system for monitoring a marine well for shallow-water flow during marine drilling operations repeats steps 104, 106 and 108 to perform a subsequent analysis of the open hole section of the marine well over a subsequent time period forming a subsequent discharge category for the open hole section of the marine well and linking the subsequent discharge category to video feed with a subsequent time stamp between a subsequent start observation time and a subsequent ending observation time, shown as step 110.

The system for monitoring a marine well for shallow-water flow during marine drilling operations compares the subsequent discharge category to the baseline discharge category to determine if a change in velocity has occurred or a change in total flow from the open hole section of the marine well has occurred, shown as step 112.

The system for monitoring a marine well for shallow-water flow during marine drilling operations performs a shallow-water flow analysis when a change in velocity, a change in total flow, or combinations thereof has been determined by analyzing logging while drilling data feed, seismic profile data feed, measurement while drilling data feed, drilling parameter data feed, and combinations thereof, to determine if the cause of the change is not related to shallow-water flow, and forms an alert shown as step 114.

Shallow-water flow analysis includes the evaluation of the logging while drilling data feed, seismic profile data feed, measurement while drilling data feed, and drilling parameter data feed.

The system for monitoring a marine well for shallow-water flow during marine drilling operations renames the subsequent discharge category as the baseline discharge category when the shallow-water flow analysis determines the change in velocity, the change in total flow or combinations thereof is not related to shallow-water flow, shown as step 116.

The system for monitoring a marine well for shallow-water flow during marine drilling operations forms an alarm and transmits the alarm for immediate action when the shallow-water flow analysis determines that the change in velocity, change in total flow, or combinations thereof is related to shallow-water flow, shown as step 118.

In embodiments, the alarm can be transmitted through the network to the plurality of client devices.

The system for monitoring a marine well for shallow-water flow during marine drilling operations can repeat steps 104, 106 and 108 when no change in velocity, no change in total flow, or combinations thereof occurs after the subsequent discharge category has been established, shown as step 120.

The system can be repeated for multiple subsequent time periods.

The seismic profile is used to determine the type of rock the drilling is penetrating and then the rock type is used in the analysis of potential shallow-water flow. Sand can allow the flow of water through them more readily than clay, and can be a reason for an increase in velocity of a discharge or for an increase in the number of ports having discharge in the open hole section of the marine well.

For example, if the drilling is in sands, the seismic profile is used to identify the tops and bases of "sand packages" in the stratigraphic sequence. Once the tops and bases of the sand packages are determined, then the type of soil being drilled through is used to determine if shallow-water flow has occurred.

The shallow-water flow analysis determines if the increase in total flow from the open hole section is not related to shallow-water flow, and if it is not related to shallow-water flow, the subsequent discharge category is renamed as the baseline discharge category.

When the shallow-water flow analysis determines that the cause of the increase in total flow is related to shallow-water flow, an alarm is formed and transmitted for immediate action.

FIGS. 6A-6D show each of the servers having a processor and data storage.

Figure 6A:
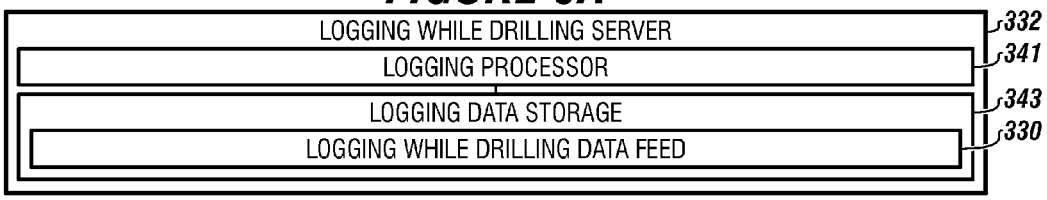
FIGS. 6A-6D depict diagrams of the various servers usable by the marine well with shallow-water flow monitoring.

FIG. 6A shows a logging while drilling server 332 with a logging processor 341 and a logging data storage 343. The logging data storage can have a logging while drilling data feed 330.

Figure 6B:
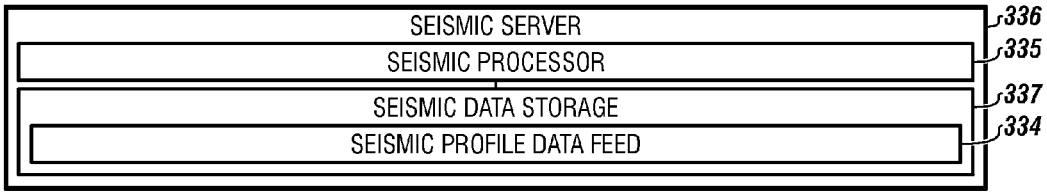

FIG. 6B shows seismic server 336 with a seismic processor 335 and a seismic data storage 337. The seismic data storage can have a seismic profile data feed 334.

Figure 6C:
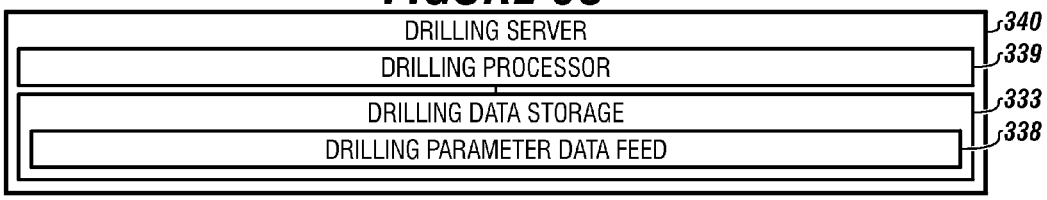

FIG. 6C shows a drilling server 340 with a drilling processor 339 and a drilling data storage 333. The drilling data storage can have a drilling parameter data feed 338.

Figure 6D:
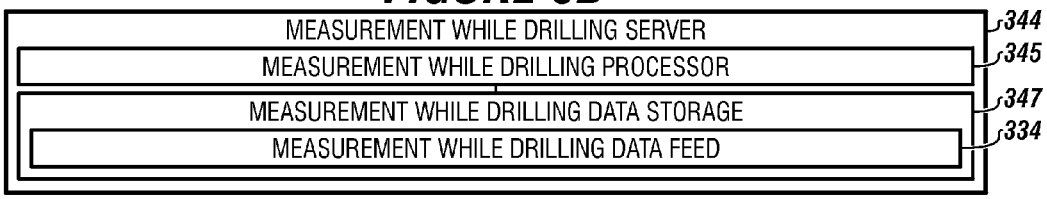

FIG. 6D shows a measurement while drilling server 344 with a measurement while drilling processor 345 and a measurement while drilling data storage 347. The measurement while drilling data storage can have a measurement while drilling data feed 334.

As an example, the system for monitoring the marine well for shallow-water flow during marine drilling operations can be used as follows:

During a first time period when mud pumps are off, the system can record an open hole section of the marine well with a video feed.

The system can record a time when the discharge of drilling fluid and cuttings ceases from the top of the open hole section of the marine well.

The system can record a time when the discharge of drilling fluid and cuttings ceases from the upper port holes of the open hole section of the marine well.

The system can record a time when the discharge of drilling fluid and cuttings ceases from the upper port valves of the open hole section of the marine well.

The system can record a time when the discharge of drilling fluid and cuttings ceases from the lower port valves of the open hole section of the marine well.

The system can record a time when the discharge of drilling fluid and cuttings ceases from the lower port holes of the open hole section of the marine well.

The system can record a time when the mud pumps are turned on, ending the first time period.

The system can compare the video feed to the discharge category model to identify a discharge that most closely matches the video feed. The system can assign a baseline discharge category to the open hole section.

During a subsequent time period when mud pumps are off, the system can record an open hole section of the marine well with a subsequent video feed.

The system can compare the subsequent video feed to the discharge category model to identify a subsequent discharge category that most closely matches the subsequent video feed.

While these embodiments have been described with emphasis on the embodiments, it should be understood that within the scope of the appended claims, the embodiments might be practiced other than as specifically described herein.

What is claimed is:

1. A system for monitoring a marine well for shallow-water flow during marine drilling operations from an open hole section during marine drilling operations using a drilling rig, wherein the system for monitoring the marine well for shallow-water flow during marine drilling operations comprises:

a. a video feed of the open hole section from a video capture device proximate the open hole section;

b. an analysis processor connected to a network and the video feed;

c. an analysis data storage, wherein the analysis data storage comprises a non-transitory computer readable medium, connected to the analysis processor;

d. computer instructions in the analysis data storage to receive a mud pumps off time from mud pumps on the drilling rig connected to the analysis processor when the mud pumps are turned off and drilling fluid no longer flows to the open hole section of the marine well;

e. computer instructions in the analysis data storage to receive and store the video feed in the analysis data storage;

f. a discharge category model in the analysis data storage providing a plurality of discharge categories of shallow-water flow for the open hole section of the marine well;

g. computer instructions in the analysis data storage for comparing the video feed during a first time period from a first mud pumps off time to the plurality of discharge categories in the discharge category model, identifying a discharge category from the discharge category model that most closely matches the video feed during a first time interval, and designating the discharge category as a baseline discharge category for the open hole section while simultaneously calculating from the video feed and the first mud pumps time off, a quantity of time required to achieve the baseline discharge category;

h. computer instructions in the analysis data storage for comparing the video feed during a subsequent time period from a subsequent mud pumps off time to the plurality of discharge categories in the discharge category model, identifying a subsequent discharge category from the discharge category model that most closely matches the video feed during a subsequent time interval, while simultaneously calculating from the video feed and the subsequent mud pumps time off and a quantity of time required to achieve the subsequent discharge category;

i. computer instructions in the analysis data storage to compare the subsequent discharge category from the subsequent time period to the baseline discharge category, and if the baseline discharge category is different or if the time period required to achieve the subsequent discharge category is different than the computer instructions designate the subsequent discharge category as the baseline discharge category;

j. computer instructions in the analysis data storage to use data feeds from at least one of a seismic profile data feed, a logging while drilling data feed, a measurement while drilling data feed, and a drilling parameters data feed to determine if anticipated changes or changes within acceptable limits have occurred in data parameters of the marine well that are not related to shallow-water flow and to verify that the subsequent discharge category should be designated as the baseline discharge category;

k. computer instructions in the analysis data storage to form an alert when the subsequent discharge category differs from the baseline discharge category or if the subsequent time period to achieve the subsequent discharge category is different than the first time period, and no anticipated changes or changes within acceptable limits have occurred in data parameters of the marine well according to at least one: the logging while drilling data feed, the seismic profile data feed, the drilling parameter data feed, and measurement while drilling data feed; and l. computer instructions in the analysis data storage to transmit an alarm to the network and to client devices in communication with the network for immediate action.

2. The system for monitoring a marine well for shallow-water flow during marine drilling operations of claim 1, wherein the analysis processor receives:

a. a logging while drilling data feed of the marine well provided in real time from a logging while drilling server using the network during drilling operations by the drilling rig;

b. a seismic profile data feed of the marine well provided in real time from a seismic server using the network during drilling operations by the drilling rig;

c. a drilling parameter data feed of the marine well provided in real time from a drilling server using the network during drilling operations by the drilling rig; and d. a measurement while drilling data feed of the marine well provided in real time from a measurement while drilling server during drilling operations by the drilling rig.

3. The system for monitoring a marine well for shallow-water flow during marine drilling operations of claim 1, wherein the discharge category model comprises:

a. a baseline discharge category zero, wherein no discharge of drilling fluids and cuttings is observed out of any port hole or port valve in the open hole section of the marine well while the mud pumps are off;

b. a baseline discharge category one, wherein there is a negligible discharge at a first velocity of drilling fluids and cuttings is observed out of either a group of lowest port holes or a group of lowest port valves if no port holes are lowest, in the open hole section of the marine well;

c. a baseline discharge category two, wherein there is a minimal flow discharge pattern at a first velocity of drilling fluids and cuttings observed out of a group of: lowest port holes and a group of: lowest port valves of the open hole section of the marine well;

d. a baseline discharge category three, wherein there is a very slight flow discharge pattern observed of drilling fluids and cuttings at a second velocity out of the open hole section of the marine well from a member of the group: the lowest port holes, lowest port valves, or combinations thereof; and a first velocity from a member of the group comprising: upper port valves, upper port holes, or combinations thereof;

e. a baseline discharge category four, wherein there is a slight flow discharge pattern observed of drilling fluids and cuttings observed out of the open hole section of the marine well with a third velocity from a member of the group: the lowest port holes, lowest port valves or combinations thereof; and either (i) a second velocity from the upper port holes, or (ii) a second velocity from upper port valves and a first velocity from the upper port holes; and f. a baseline discharge category five, wherein there is a minor discharge pattern observed of drilling fluids and cuttings out of the open hole section of the marine well with a third velocity from a member of the group: the lowest port holes, lowest port valves or combinations thereof; and a third velocity from upper port valves, and a second velocity from upper port holes, or combinations thereof.

4. The system for monitoring a marine well for shallow-water flow during marine drilling operations of claim 3, comprising a power supply connected to the video capture device.

5. The system for monitoring a marine well for shallow-water flow during marine drilling operations of claim 2, wherein the logging while drilling server comprises a logging processor with logging data storage to store and provide the logging while drilling data feed in real time to the network.

6. The system for monitoring a marine well for shallow-water flow during marine drilling operations of claim 2, wherein the seismic server comprises a seismic processor with seismic data storage to store and provide the seismic profile data while drilling data in real time to the network.

7. The system for monitoring a marine well for shallow-water flow during marine drilling operations of claim 2, wherein the drilling server comprises a drilling parameter processor with drilling data storage to store and provide the drilling parameters while drilling data in real time to the network.

8. The system for monitoring a marine well for shallow-water flow during marine drilling operations of claim 2, wherein the measurement while drilling (MWD) server comprises a measurement while drilling processor with measurement while drilling data storage to store and provide the measurement while drilling data feed in real time to the network.

9. The system for monitoring a marine well for shallow-water flow during marine drilling operations of claim 1, wherein the discharge in the open hole section exits from a plurality of valves and holes.

10. The system for monitoring a marine well for shallow-water flow during marine drilling operations of claim 1, comprising at least one client device in communication with the network, wherein each client device is at least one of a laptop, computer, cell phone, personal digital assistant, or remote monitoring device with display for presenting the status of the open hole section to a viewer.

11. The system for monitoring a marine well for shallow-water flow during marine drilling operations of claim 1, further comprising in the analysis data storage computer instructions to create a time stamp and place the time stamp on individual images of the video feed.

* * * * *